US011035016B2

(12) United States Patent
Crafton

(10) Patent No.: US 11,035,016 B2
(45) **Date of Patent: *Jun. 15, 2021**

(54) SYSTEM AND METHOD FOR IMPROVING QUENCH AIR FLOW

(71) Applicant: Consolidated Engineering Company, Inc., Kennesaw, GA (US)

(72) Inventor: Scott P. Crafton, Marietta, GA (US)

(73) Assignee: Consolidated Engineering Company, Inc., Kennesaw, GA (US)

( * ) Notice: Subject to any disclaimer, the term of this patent is extended or adjusted under 35 U.S.C. 154(b) by 105 days.

This patent is subject to a terminal disclaimer.

(21) Appl. No.: 16/393,985

(22) Filed: Apr. 25, 2019

(65) Prior Publication Data

US 2019/0382858 A1 Dec. 19, 2019

Related U.S. Application Data

(63) Continuation of application No. 15/177,504, filed on Jun. 9, 2016, now Pat. No. 10,308,993.

(Continued)

(51) Int. Cl.

| | |
|---|---|
| ***C21D 1/613*** | (2006.01) |
| ***C21D 9/00*** | (2006.01) |
| ***C21D 1/62*** | (2006.01) |

(52) U.S. Cl.

CPC ..... *C21D 1/613* (2013.01); *C21D 1/62* (2013.01); *C21D 9/0025* (2013.01); *C21D 9/0068* (2013.01)

(58) Field of Classification Search

CPC ..... C21D 1/613; C21D 1/62; C21D 9/0025; C21D 9/0068

See application file for complete search history.

(56) References Cited

U.S. PATENT DOCUMENTS

| | | | |
|---|---|---|---|
| 2,390,238 | A | 2/1943 | Dean |
| 3,262,822 | A | 7/1966 | Griffith |

(Continued)

FOREIGN PATENT DOCUMENTS

| | | | |
|---|---|---|---|
| DE | 19909519 | A1 | 2/2000 |
| DE | 102011105447 | A1 | 12/2012 |

(Continued)

OTHER PUBLICATIONS

Manente, Andrea and Timelli, Giulio, Optimizing the Heat Treatment Process of Cast Aluminium Alloys, Recent Trends in Processing and Degradation of Aluminium Alloys, Prof. Zaki Ahmad (Ed.), ISBN: 978-953-307-734-5, InTech, Available from: http://www.intechopen.com/books/recent-trends-in-processing-and-degradation-of-aluminium-alloys/optimitzing-the-heat-treatment-process-of-cast-aluminum-alloys, Nov. 2011, pp. 197-220, InTech, Rijeka, Croatia.

(Continued)

*Primary Examiner* — Scott R Kastler
(74) *Attorney, Agent, or Firm* — Womble Bond Dickinson (US) LLP

(57) ABSTRACT

A quench system for applying cooling air to one or more hot metallic components that are supported on a component support having a substantially open construction. The quench system includes a housing having sidewalls that define a cooling chamber with peripheral portions proximate the sidewalls and a center portion spaced inwardly from the sidewalls. The quench system also includes a conveyance system that is configured to carry the component support into the center portion of the cooling chamber, as well as a forced air fan that generates a bulk flow of cooling air through the cooling chamber. The quench system further includes a plurality of nozzle baffles extending inwardly from the plurality of sidewalls to define a narrowing region within the housing between the forced air fan and the (Continued)

conveyance system, whereby, during operation of the fan, cooling air flowing through the peripheral portions of the cooling chamber is redirected into the center portion of the cooling chamber.

12 Claims, 5 Drawing Sheets

Related U.S. Application Data

(60) Provisional application No. 62/197,199, filed on Jul. 27, 2015.

(56) References Cited

U.S. PATENT DOCUMENTS

| | | | | |
|---|---|---|---|---|
| 4,002,502 | A | 1/1977 | Bainbridge et al. | |
| 5,112,412 | A | 5/1992 | Planta et al. | |
| 5,284,327 | A | 2/1994 | Arthur et al. | |
| 5,350,160 | A | 9/1994 | Crafton et al. | |
| 5,419,792 | A | 5/1995 | King et al. | |
| 5,529,645 | A | 6/1996 | Oswalt | |
| 5,634,512 | A | 6/1997 | Bombardelli et al. | |
| 5,788,784 | A | 8/1998 | Koppenhoefer et al. | |
| 5,922,147 | A | 7/1999 | Valtierra-Gallardo et al. | |
| 6,074,599 | A * | 6/2000 | Murty | C21D 1/613 266/259 |
| 6,224,393 | B1 | 5/2001 | Garza-Ondarza et al. | |
| 6,224,693 | B1 | 5/2001 | Garza-Ondarza et al. | |
| 6,368,430 | B1 | 4/2002 | Bennon et al. | |
| 6,752,885 | B1 | 6/2004 | Jerichow | |
| 7,503,986 | B2 | 3/2009 | Kamat et al. | |
| 8,168,015 | B2 | 5/2012 | Doty | |
| 8,409,374 | B2 | 4/2013 | Lumley et al. | |
| 8,447,574 | B2 | 5/2013 | Wang et al. | |
| 8,636,855 | B2 | 1/2014 | Wang et al. | |
| 8,758,529 | B2 | 6/2014 | Wang et al. | |
| 10,308,993 | B2 * | 6/2019 | Crafton | C21D 1/62 |
| 2002/0129921 | A1 | 9/2002 | Frank et al. | |
| 2007/0051443 | A1 | 3/2007 | Lukasak et al. | |
| 2008/0011443 | A1 | 1/2008 | Crafton et al. | |
| 2009/0000710 | A1 | 1/2009 | Ford et al. | |
| 2010/0101691 | A1 | 4/2010 | Doty | |
| 2010/0224289 | A1 | 9/2010 | Wang et al. | |
| 2010/0224293 | A1 | 9/2010 | Wang et al. | |
| 2011/0303385 | A1 | 12/2011 | Salina-Pena et al. | |
| 2012/0041726 | A1 | 2/2012 | Wang et al. | |
| 2016/0362758 | A1 | 12/2016 | Crafton | |
| 2018/0237884 | A1 * | 8/2018 | Crafton | C21D 9/0025 |
| 2019/0382858 | A1 * | 12/2019 | Crafton | C21D 1/62 |

FOREIGN PATENT DOCUMENTS

| | | | |
|---|---|---|---|
| DE | 102012017711 | A1 | 3/2013 |
| DE | 102011118463 | A1 | 5/2013 |
| JP | 02254141 | A | 3/1989 |
| JP | 2008248283 | A | 10/2008 |
| WO | WO 2014/068493 | A1 | 5/2014 |
| WO | WO 2014/068494 | A1 | 5/2014 |

OTHER PUBLICATIONS

International Search Report & Written Opinion dated Nov. 24, 2015, from PCT Application No. PCT/US2015/050336.
International Search Report & Written Opinion for co-pending PCT Application No. PCT/US2016/036583.

* cited by examiner

SYSTEM AND METHOD FOR IMPROVING QUENCH AIR FLOW

CROSS-REFERENCE TO RELATED APPLICATIONS

This application is a continuation of U.S. patent application Ser. No. 15/177,504, filed Jun. 9, 2016 and now issued as U.S. Pat. No. 10,308,993; which application claims the benefit of U.S. Provisional Patent Application No. 62/174,821, filed Jun. 12, 2015, and U.S. Provisional Patent Application No. 62/197,199, filed Jul. 27, 2015. Each of the above listed patent and applications are incorporated by reference in their entirety herein and for all purposes.

FIELD OF THE INVENTION

The present invention generally relates to quench systems for cooling hot metallic components, such as aluminum castings for automotive engine blocks and cylinder heads, after removal from a heat treatment furnace.

BACKGROUND

Quench systems for cooling hot metallic components after removal from a heat treatment furnace, such as hot forgings or castings made from steel or aluminum alloys, are known in the art. As shown in FIG. 1, for instance, a typical forced air quench system 10 can often provide a flow of cooling air 90 from rotating fans located in a lower portion of the quench housing 20. The cooling air 90 flows upward from the fans and around, and some cases through, a plurality of metallic components 80 that are supported on a casting tray 60. As known to those of skill in the art, the casting tray 60 is generally a rigid metallic framework having a substantially open construction with large openings 64 defined by support ribs 62, and which is configured to maintain its shape during repeated thermal cycling through the hot furnace and subsequent cooling quench. The large openings 64 in the casting tray 60 can allow molding sand that falls out of the metallic components 80 during the heat treatment process to pass through the trays to lower sections of the heat treatment furnace (not shown), and then provide minimal obstruction for the cooling air 90 to flow upward, around and through the metallic components 80 after placement into the quench housing 20. In addition, the casting tray 60 is typically supported on a plurality of support rollers 32 of a roller conveyor 30 that moves the casting tray into and out of the quench housing 20, with the forced cooling air 90 from the fans flowing upward through gaps 34 between the rollers 32 prior to encountering the casting tray 60 and the metallic components 80 supported thereon.

Also illustrated in FIG. 1, the cooling air 90 typically flows upward from the fans at a predetermined and substantially uniform flow rate and speed across the entire width of the quench housing 20, to cool the metallic components 80 that are supported on the casting tray 60 in the center portion 22 of the housing. The flow rate of the cooling air 90 is generally determined by the size and speed of the fans and the cross-sectional area of the quench housing 20. In some installations the fans can be provided with variable speed drives that allow the flow rate to be increased or decreased depending on operating parameters, so as to quench the metallic components in accordance with a desired temperature profile or within a desired period of time. However, variable speed drives can add significant cost and complexity to the system, which can be undesirable. Although both the constant speed and variable speed versions of this generalized quench system design have proven adequate in many existing heat treatment installations, in some newer applications the flow rate of the cooling air 90 has been found insufficient for cooling larger and/or more complex metallic components within a desired time frame.

Consequently, a need exists for an improved forced air quench system and method that allows an operator to more efficiently cool larger and/or complex metallic components with a desired period of time. It is toward such an improved forced quench air system that the present disclosure is directed.

SUMMARY

Briefly described, one embodiment of the present disclosure comprises a quench system for applying cooling air to a hot metallic component, such as the metallic components described above, that is supported on a component support having a substantially open construction allowing for air flow therethrough. The quench system includes a housing with sidewalls that define a cooling chamber with peripheral portions proximate the sidewalls and a center portion spaced inwardly from the sidewalls. The quench system also includes a conveyance system that is configured to carry the component support with hot metallic component into the center portion of the cooling chamber. The quench system further includes a forced air fan for generating a bulk flow of cooling air through the cooling chamber, as well as a plurality of nozzle baffles extending inwardly from the sidewalls to define a narrowing region within the housing between the forced air fan and the conveyance system, whereby, during operation of the fan, cooling air flowing through the peripheral portions of the cooling chamber is redirected into the center portion of the cooling chamber. This redirection of the cooling air can affect a first stage increase in the average velocity of the cooling air flowing through the cooling chamber prior to encountering the hot metallic components. In one aspect the quench system also includes a plurality of central baffles located within or proximate the gaps between support rollers of the conveyance system, and that are configured to further redirect the cooling air into channels between the central baffles and the support rollers to affect a second stage increase in the average velocity of the cooling air flowing through the cooling chamber prior to encountering the hot metallic components.

In accordance with another embodiment, the present disclosure also includes a quench system for applying cooling air to one or more hot metallic components supported on a component support having a substantially open construction allowing for air flow therethrough. The quench system includes a housing having sidewalls that define a cooling chamber with peripheral portions proximate the sidewalls and a center portion spaced inwardly from the sidewalls. The quench system also includes a porous platform located within the cooling chamber that is configured to position the component support and hot metallic components proximate the center portion of the cooling chamber, as well as a forced air fan for generating a bulk flow of cooling air through the cooling chamber at a first average velocity. The quench system further includes a first set of flow directing elements, such as a set of fixed nozzle baffles, located upstream of the hot metallic components, and which first set of flow directing elements is configured to increase the flowrate of the cooling air to a second average velocity greater than the first average velocity. The quench system also includes a second set of flow directing elements, such as a set of movable center baffles, located between the first set of baffles and the hot metallic components, and which second set of flow directing elements is configured to further increase the flowrate of the cooling air to a third average velocity that is greater than the first and second average velocities.

In accordance with yet another embodiment, the present disclosure also includes a method for applying cooling air to a hot metallic component that includes supporting one or more hot metallic components on a component support having a substantially open construction allowing air flow therethrough. The method also includes positioning the component support within the cooling chamber of a quench system, and generating a bulk flow of cooling air through the cooling chamber at a first average velocity. The method further includes affecting a first stage increase in the flowrate of the cooling air to a second average velocity that is greater than the first average velocity, followed by affecting a second stage increase in the flowrate of the cooling air to a third average velocity that is greater than the first average velocity, and then directing the cooling air against the hot metallic components to increase the heat transfer away from the components.

The invention will be better understood upon review of the detailed description set forth below taken in conjunction with the accompanying drawing figures, which are briefly described as follows.

Those skilled in the art will appreciate and understand that, according to common practice, various features and elements of the drawings described above are not necessarily drawn to scale, and that the dimensions of the various features and elements may be expanded or reduced to more clearly illustrate the embodiments of the present disclosure described therein.

DETAILED DESCRIPTION

The following description, in conjunction with the accompanying drawings described above, is provided as an enabling teaching of exemplary embodiments of a system for improving quench air flow, and one or more methods for improving the flow of cooling air within a forced quench air system. As described below, the improved forced air quench system can provide several significant advantages and benefits over other forced-air type quench systems. However, the recited advantages are not meant to be limiting in any way, as one skilled in the art will appreciate that other advantages may also be realized upon practicing the present disclosure.

Furthermore, those skilled in the relevant art will recognize that changes can be made to the described embodiments while still obtaining the beneficial results. It will also be apparent that some of the advantages and benefits of the described embodiments can be obtained by selecting some of the features of the embodiments without utilizing other features, and that features from one embodiment may be combined with features from other embodiments in any appropriate combination. For example, any individual or collective features of method embodiments may be applied to apparatus, product or system embodiments, and vice versa. Accordingly, those who work in the art will recognize that many modifications and adaptations to the embodiments described are possible and may even be desirable in certain circumstances, and are a part of the disclosure. Thus, the present disclosure is provided as an illustration of the principles of the embodiments and not in limitation thereof, since the scope of the invention is to be defined by the claims.

Figure 1:
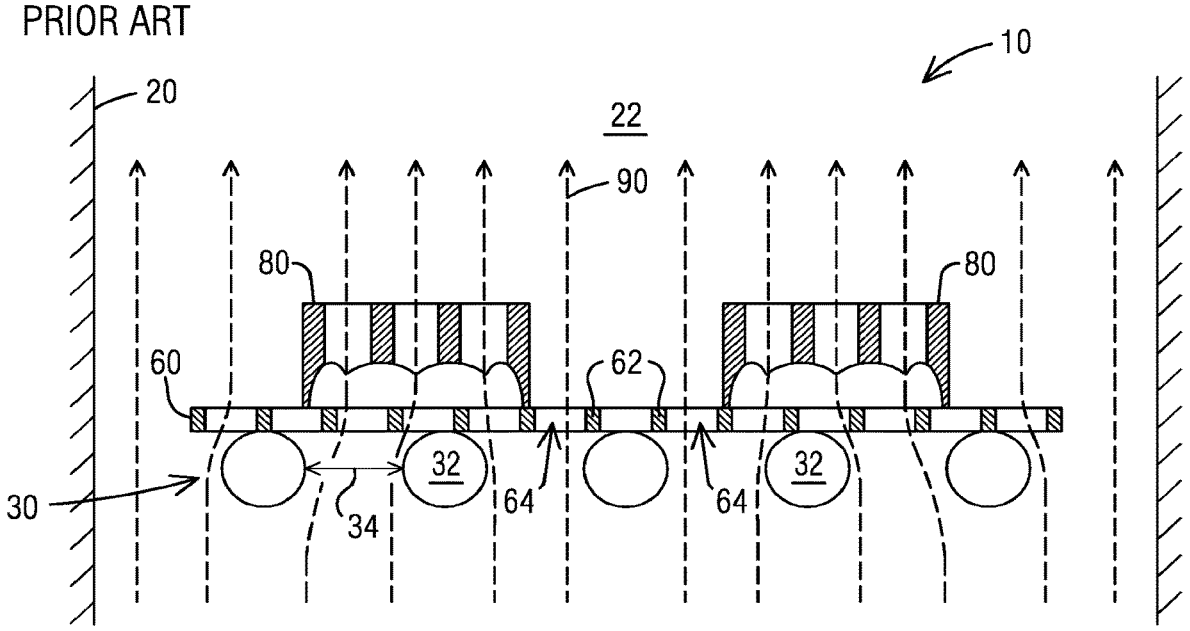
FIG. 1 PRIOR ART
FIG. 1 is a schematic side view of a quench system for cooling metallic components, as generally known in the art
Figure 2:
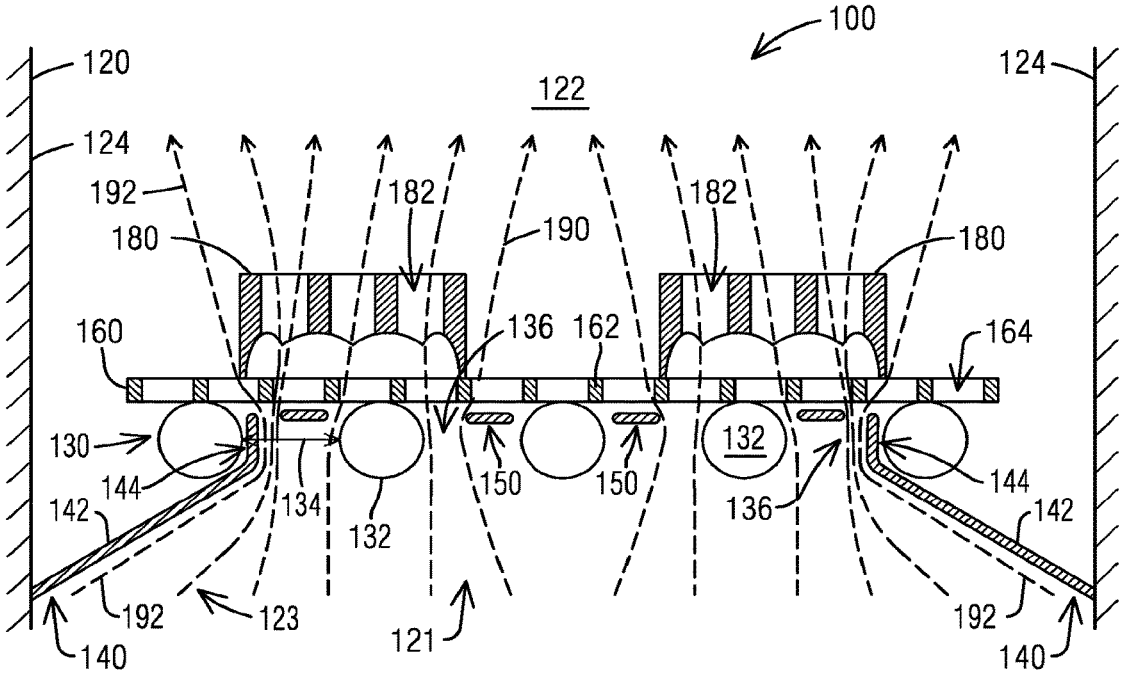
FIG. 2 is a schematic side view of a quench system for cooling metallic components, in accordance with one representative embodiment of the present disclosure.

Referring now in more detail to the drawing figures, wherein like parts are identified with like reference numerals throughout the several views, FIG. 2 illustrates a forced air quench system 100 for cooling metallic components 180, in accordance with one representative embodiment of the present disclosure. While the hot metallic components can be forgings or castings made from steel or aluminum alloys, and the like, for the purpose of convenience and brevity the components will generally be referenced herein as castings made from aluminum alloy.

The forced air quench system 100 generally includes a quench enclosure or housing 120 with sidewalls 124 that define a quench or cooling chamber 122 having peripheral portions 123 proximate the sidewalls 124 and a center portion 121 spaced inwardly from the sidewalls. The quench system 100 also includes a conveyance system that carries a component support, such as casting tray 160, into the center portion 121 of the cooling chamber 122. In one aspect the conveyance system can be a roller conveyor system 130 having a plurality of support rollers 132 extending across the center portion 121 of the cooling chamber 122, and that serve as a platform that positions the component support within or proximate to the center portion 121 the cooling chamber 122 during the quench process. Force air fans (not shown) can be located within a lower portion of the quench housing 120 for providing a stream of cooling air 190 that flows upward through the cooling chamber 122 to exit through one or more openings (also not shown) in the upper portion of the quench housing. The roller conveyor system 130 is configured to move one or more casting trays 160 loaded with metallic components 180 into the center portion 121 of the cooling chamber 122 where it will encounter the cooling air 190 provided by the forced air fans.

Although in FIG. 2 the conveyance system is shown as a roller conveyor system 130 and the component support is shown as a casting tray 160, it will be appreciated that other types of conveyance systems and component supports are also possible and considered to fall within the scope of the present disclosure. For instance, the component support could also be a rack, a basket, and the like, with each having a substantially open construction allowing cooling air to flow therethrough. Likewise, the conveyance system could also be a chain conveyor, a slotted belt conveyor, a robotic manipulator, and the like, with each being capable of carrying the component support, or even the hot metallic component directly in some embodiments, into the center portion 121 of the cooling chamber 122. In addition, in other aspects the conveyance system may include a platform located within cooling chamber upon which the component support is deposited, and which platform is configured to position the component support within or proximate the center portion of the cooling chamber.

As illustrated in FIG. 2, the forced air quench system 100 can include a plurality of nozzle baffles 140 that extend inward from sidewalls 124 of the quench housing 120 to the inside of the outermost rollers 132 of the roller conveyor 130, and that define a narrowing region within the housing between the forced air fan and the platform. During operation of the fan, the nozzle baffles 140 can operate to redirect those portions 192 of the cooling air 190 that flow upward through the peripheral portions 123 of the cooling chamber 122 away from the sidewalls 124 and toward the center portion 121 of the cooling chamber 122, thereby affecting a first stage increase in the velocity of the forced cooling air 190 as it flows upward through the casting tray 160. In one aspect the nozzle baffles 140 can include fixed upwardly and inwardly sloped portions 142 that curve aerodynamically into vertical lips 144 that extend upward and adjacent to the inside of the outermost rollers 132 of the conveyance system 130, without contacting the rollers 132, so as to maximize the first stage increase in the average velocity of the cooling air 190 while minimizing pressure losses. However, other configurations and/or shapes for the nozzle baffles 140 are possible and considered to fall within the scope of the present disclosure.

Although not shown in the schematic side view of FIG. 2, it is to be appreciated that similar nozzle baffles can also extend inward from the sidewalls of the quench housing 120 that are perpendicular to the sidewalls 124 shown in the drawing (i.e. into or out of the paper of the drawing). In this case the nozzle baffles can include notches or cutouts that fit around the support rollers 132. Thus, in some aspects the set of nozzle baffles 140 can redirect and focus the forced cooling air 190 into an area that substantially corresponds to the footprint of the casting tray 160, or even the footprint of the portion of the casting tray 160 that supports the metallic components 180, and which will generally be much smaller than the total cross-sectional area of the quench closure 120. Thus, the set of nozzle baffles 140 can provide a first redirection or concentration of the forced air flow and a corresponding first stage increase in the average flow rate or velocity of the cooling air 190.

Also illustrated in FIG. 2, in some embodiments the forced air quench system 100 can further include a plurality of movable central baffles 150 that are located within or near to the gaps 134 between support rollers 132 in the center portion 121 of the quench enclosure or housing 120. Although viewed from their ends in the drawing, it is to be appreciated that the set of central baffles 150 can be elongate, vane-shaped structures that can substantially span the length of the support rollers. In addition, the central baffles 150 can be supported, either at their ends or at one or more mid-span locations, with an actuated support system that can move or rotate the central baffles 150 from the substantially horizontal orientation shown in FIG. 2 to a substantially vertical orientation, as well as any desired angular orientation therebetween. As indicated in FIG. 2, when moved into a horizontal or angled orientation, the set of central baffles can function to further redirect and concentrate the upwardly-flowing forced cooling air into narrow gaps or channels 136 between the central baffles 150 and the outer circumferential surfaces of the support rollers 132 to form directed streams of cooling air, thereby further increasing the velocity of the cooling air 190 within the directed streams as it flows around and through the metallic components 180. This second and more localized redirection and concentration of the forced air flow can comprise a second stage increase in the average flow velocity, leading to a corresponding increase in the rate at which heat is collected and drawn away from the hot surfaces of the metallic components being quenched.

Although not visible in FIG. 2, in one aspect the width of the individual central baffles 150 may vary along the length of the vane-shaped structure (i.e. while moving perpendicular to the plane of the drawing) so as to define channels of varying size and shape that can be optimized to better define and shape the directed streams of cooling air 190. For example, in some aspects the profile of the central baffles 150 can be shaped to match large openings 182 formed through the metallic components 180 themselves (for example, empty cylinder bores or crank shaft bores), so that a high velocity stream of cooling air can be directed to flow upward through the interior of the metallic components in addition to the high velocity streams of cooling air flowing across the exterior surfaces of the metallic components 180. In this way a greater proportion of the cooling air provided by the forced air fans can be utilized to cool the metallic components, thereby increasing the effectiveness, efficiency and cooling rates of the quench system 100.

As shown in FIG. 2, in one embodiment the roller conveyor system 130 extending across the center portion 121 of the cooling chamber 122, together with the plurality of nozzle baffles 140 and movable central baffles 150 associated with that roller conveyor system 130, can define a quench station having a two stage increase in the average velocity of the cooling air. Alternatively, other embodiments having a conveyance system configured to carry a component support into the center portion of the cooling chamber, but without one of the set of nozzle baffles or the set of movable central baffles, may also define a quench station having only a single stage increase in the velocity of the cooling air.

Figure 3:
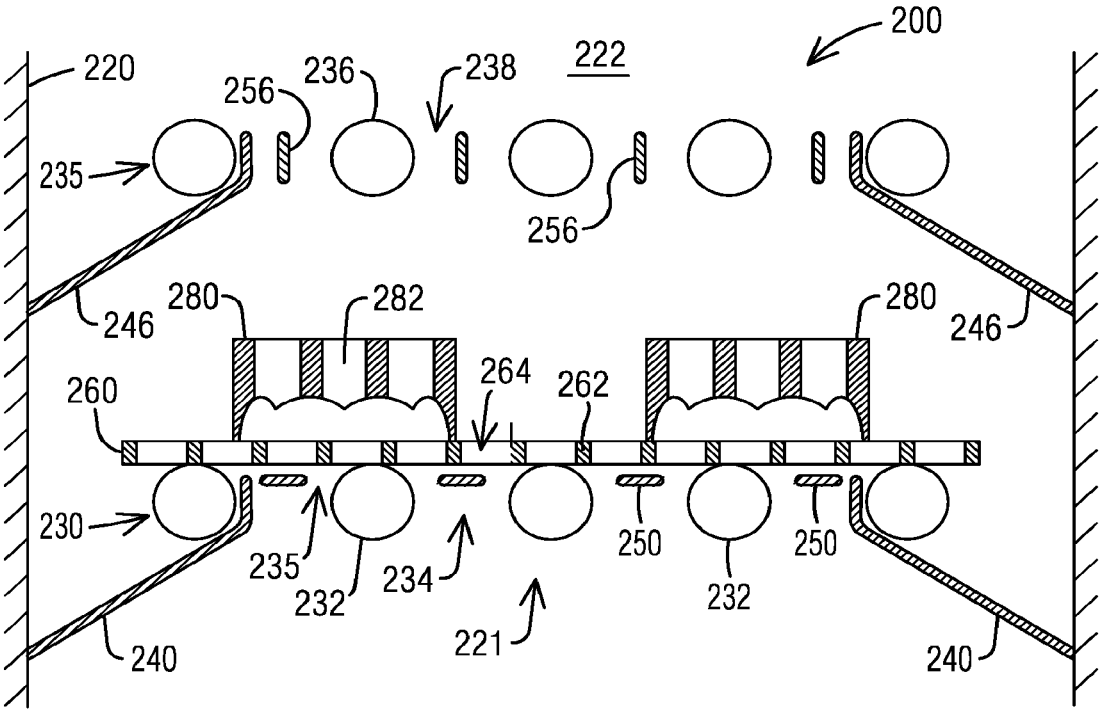
FIGS. 3 and 4 are schematic side views of a quench system for cooling metallic components, in accordance with another representative embodiment of the present disclosure.
Figure 4:
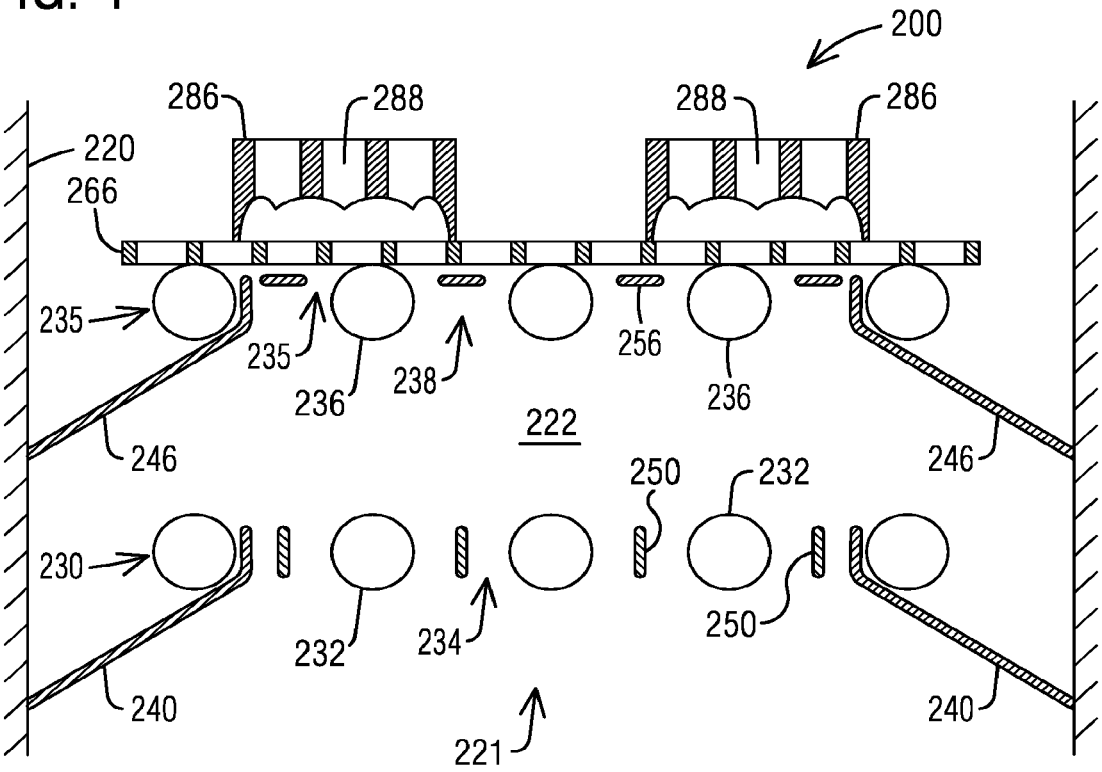

FIGS. 3 and 4 are schematic side views of another representative embodiment of the improved forced air quench system 200 that includes two roller conveyor systems 230, 235, with a second or upper roller conveyor 235 positioned directly above the first or lower roller conveyor 230 in the center portion 221 of the cooling chamber 222 of the quench enclosure or housing 220 so that the stream of cooling air provided by the forced air fans (not shown) flows upward through both quench stations. Adding the second roller conveyor 235 can be useful for minimizing the switch out time between a first casting tray 260 loaded with a first group of metallic components 280 and a second casting tray 266 loaded with a second group of metallic components 286 (FIG. 4), as the upper casting tray 266 can be moved into position on the upper quench station without interfering with the simultaneous withdrawal of the lower casting tray 260 from the lower quench station.

Both quench stations in the forced air quench system 200 can include a set of nozzle baffles 240, 246 and a set of movable central baffles 250, 256 that are positioned in the gaps 234, 238 between the support rollers 232, 236. As described above, the nozzle baffles 240, 246 can serve to redirect and focus the forced cooling air into areas that substantially correspond with the footprints of the portions of the lower and upper casting trays 160, 166, respectively, that support the metallic components 180, 186. As these flow areas will generally be much smaller than the total cross-sectional area of the quench closure 220, the nozzle baffles 240, 246 can provide a first redirection or concentration of the forced air flow and a corresponding first stage increase in flow velocity.

Also as described above, the movable central baffles 250, 256 that are positioned in the gaps 234, 238 between the support rollers 232, 236 can provide a second and more localized redirection or concentration of the forced air flow and a corresponding second stage increase in flow velocity. The central baffles can function to further redirect and concentrate the upwardly-flowing forced cooling air into narrow gaps or channels 235 between the central baffles 150 and the outer circumferential surfaces of the support rollers 232, and in one aspect can include shaped profiles that define and shape the directed streams of cooling air to correspond with openings and/or other structures formed into the metallic components above. In this way the cooling streams can be tailored to provide improved cooling for specific metallic components.

As illustrated in FIG. 3, when the first casting tray 260 loaded with a first group of metallic components 280 is positioned within the lower quench station, the central baffles 250 that are associated with the first station can be moved or rotated to their active orientations (in this case, a horizontal orientation) that redirects and concentrates the upwardly-flowing forced cooling air into narrow gaps or shaped channels 235 that correspond with the openings 282 and/or other structures formed into the metallic components 280 above. At the same time, the central baffles 256 that are associated with the second station can be moved or rotated to their vertical or inactive orientations so as to reduce the backpressure generated by the overlying structures.

For similar reasons, when the first casting tray 260 is withdrawn from the lower quench station and the second casting tray 266 loaded with a second group of metallic components 286 is positioned within the upper quench station, as shown in FIG. 4, the central baffles 250 that are associated with the first station can be moved or rotated to their vertical or inactive orientations so as to reduce the pressure losses generated by the underlying structures. At the same time, the central baffles 256 that are associated with the second station can be moved or rotated to their active orientations (e.g. a horizontal orientation) that redirects and concentrates the upwardly-flowing forced cooling air into narrow gaps or shaped channels that correspond with the openings 288 and/or other structures formed into the metallic components 286 above.

Figure 5A:
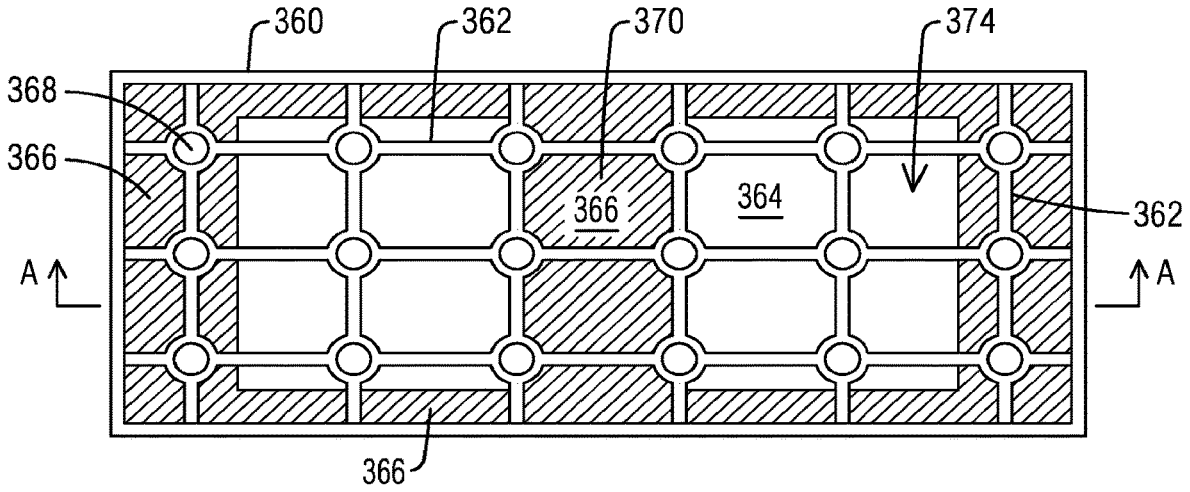
FIGS. 5A and 5B are plan and side elevation schematic views of a casting tray for supporting metallic components in a forced air quench system, in accordance with yet another representative embodiment of the present disclosure.
Figure 5B:
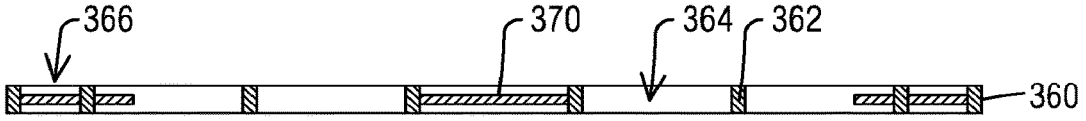
Figure 6:
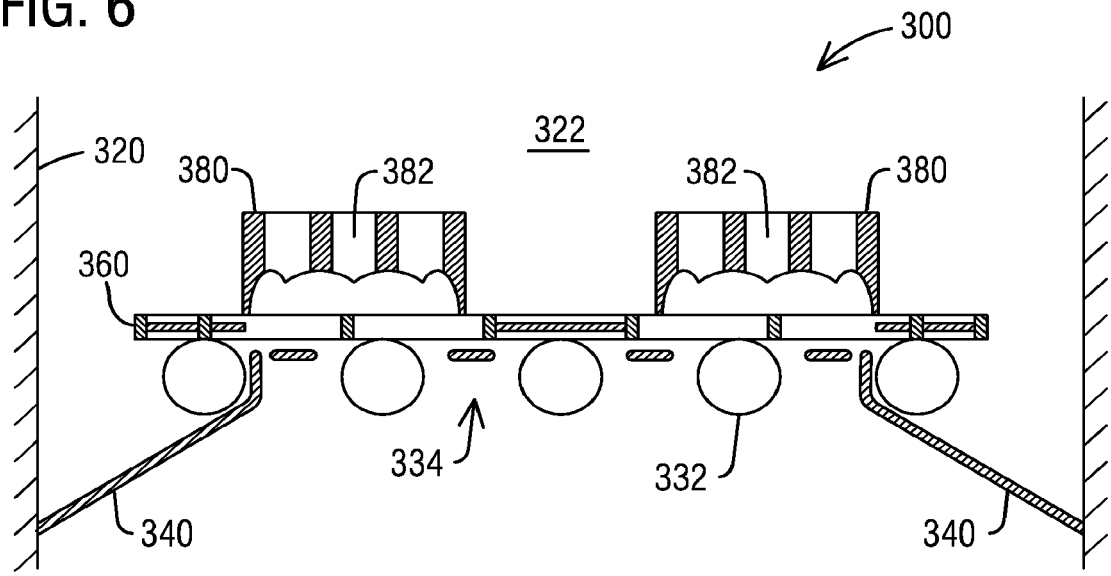
FIG. 6 is a schematic side view of the casting tray of FIG. 5 being used within a forced air quench system, in accordance with another representative embodiment of the present disclosure.

In another embodiment of the forced air quench system shown in FIGS. 5A-5B and FIG. 6, the component support (i.e. casting tray 360) can be modified to include one or more additional flow directing elements (i.e. tray baffles 370) that serve to cover or block portions 366 of the large openings 364 located around the perimeter of the castings 380, while leaving uncovered the portions of the large openings 364 that are underneath the metallic components 380. Depending on its construction, in some embodiments the casting tray 360 can also include a plurality of smaller openings 368 formed through the thickness of the tray, and which smaller openings 368 may not be covered by the tray baffles 370 to allow a portion of the cooling air to continue to pass around the outside of the metallic components. Once positioned within the forced air quench system 300, as shown in FIG. 6, the tray baffles 370 can align with the nozzle baffles 340 and the gaps 334 between the support rollers 332 to further redirect and concentrate the upwardly-flowing forced cooling air into the footprints of the metallic components 380.

As shown in FIG. 5B, in one aspect the tray baffles 370 can be positioned at a mid-height level between the ribs 362, so that the casting tray is reversible and can be flipped between loadings without any change in contact between successive groups of metallic components 380. Alternatively, the tray baffles 370 can be mounted to either an upper surface or lower surface of the casting tray 360, and in one aspect (not shown) can also be curved upward out-of-plane relative to the plane of the casting tray 360 to provide a more aerodynamic redirection of the cooling air flow.

Figure 7:
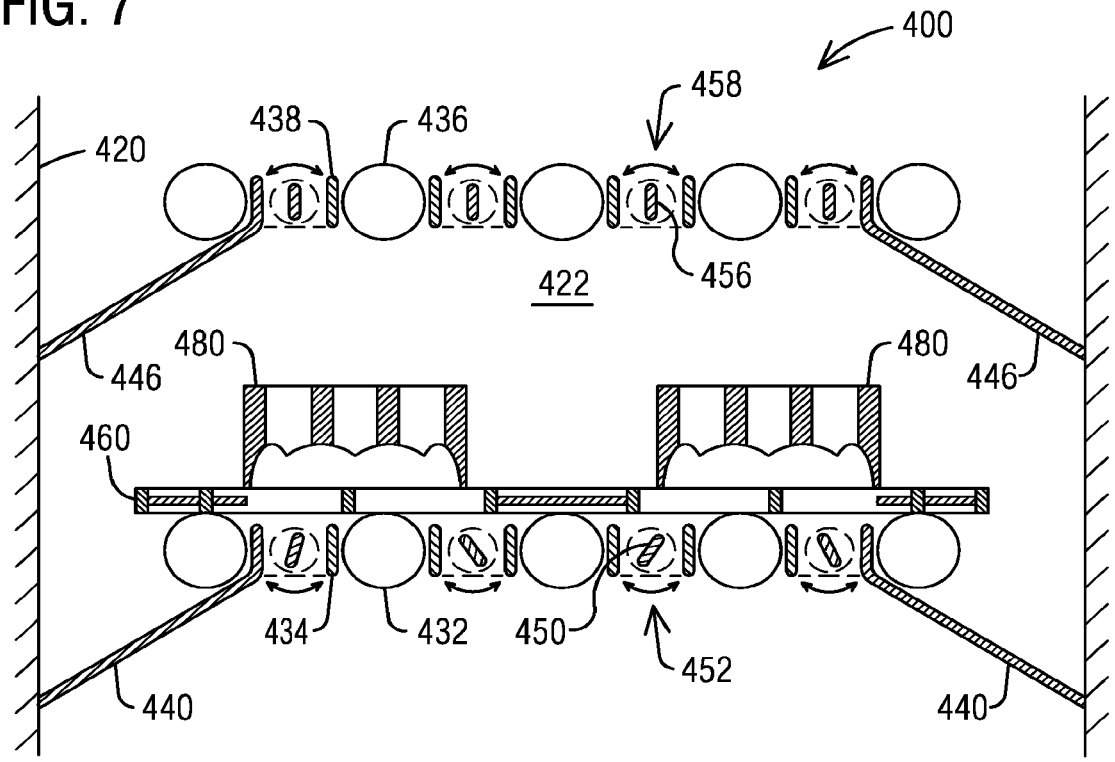
FIG. 7 is a schematic side view of a quench system for cooling metallic components, in accordance with yet another representative embodiment of the present disclosure

In yet another embodiment of the improved forced air quench system illustrated in FIG. 7, the movable central baffles 450, 456 in the upper and lower quench stations can be configured as part of modular and interchangeable baffle units 452, 458, respectively. In this way each of the central baffles 450, 456 in the modular baffle units 452, 458 can be customized for a particular type or size of casting, so as to define and shape the direct streams of cooling air and provide improved cooling for specific metallic components. In addition, each of the modular baffle units 452, 458 may be configured for mounting with a support frame 434, 438 that is located between or at the ends of the support rollers 432, 436. As describe above, the movable central baffles 450, 456 can operate together with the generally-fixed nozzle baffles 440, 446 extending inward from the sidewalls 424 of the quench enclosure or housing 420 to provide at least a two-stage increase in the flow rate or velocity of the cooling air.

Figure 8:
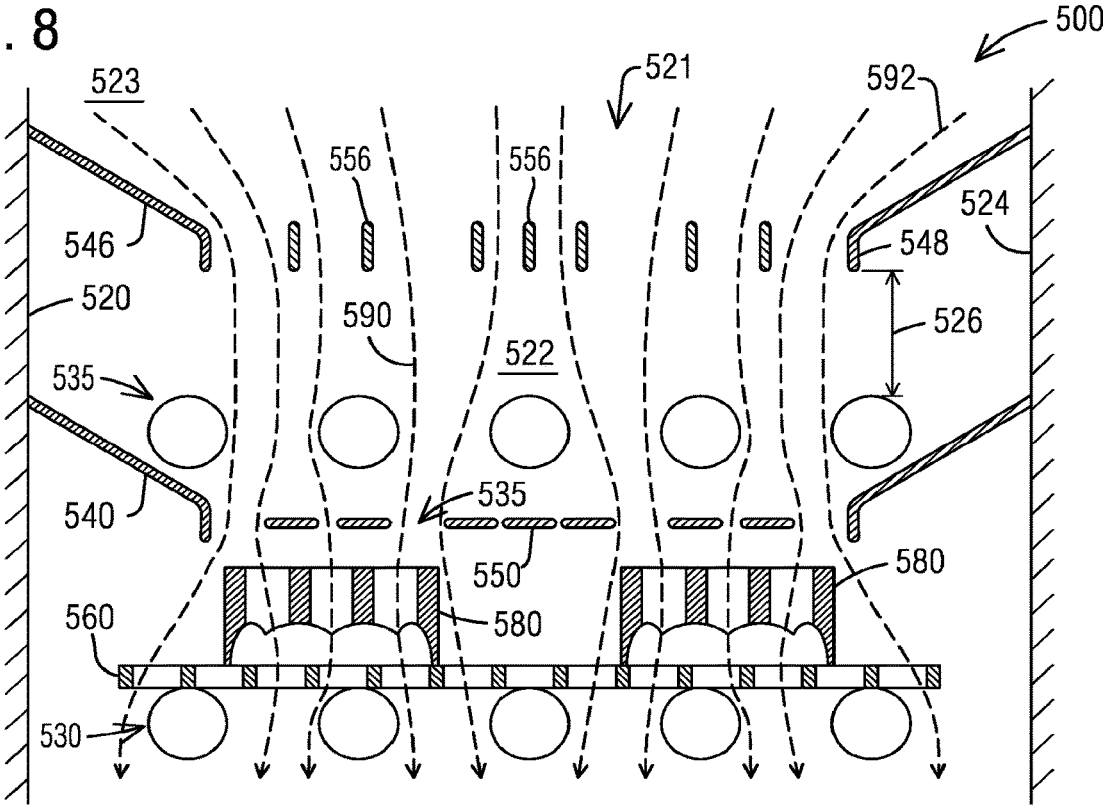
FIGS. 8 and 9 are schematic side views of a quench system for cooling metallic components, in accordance with another representative embodiment of the present disclosure.
Figure 9:
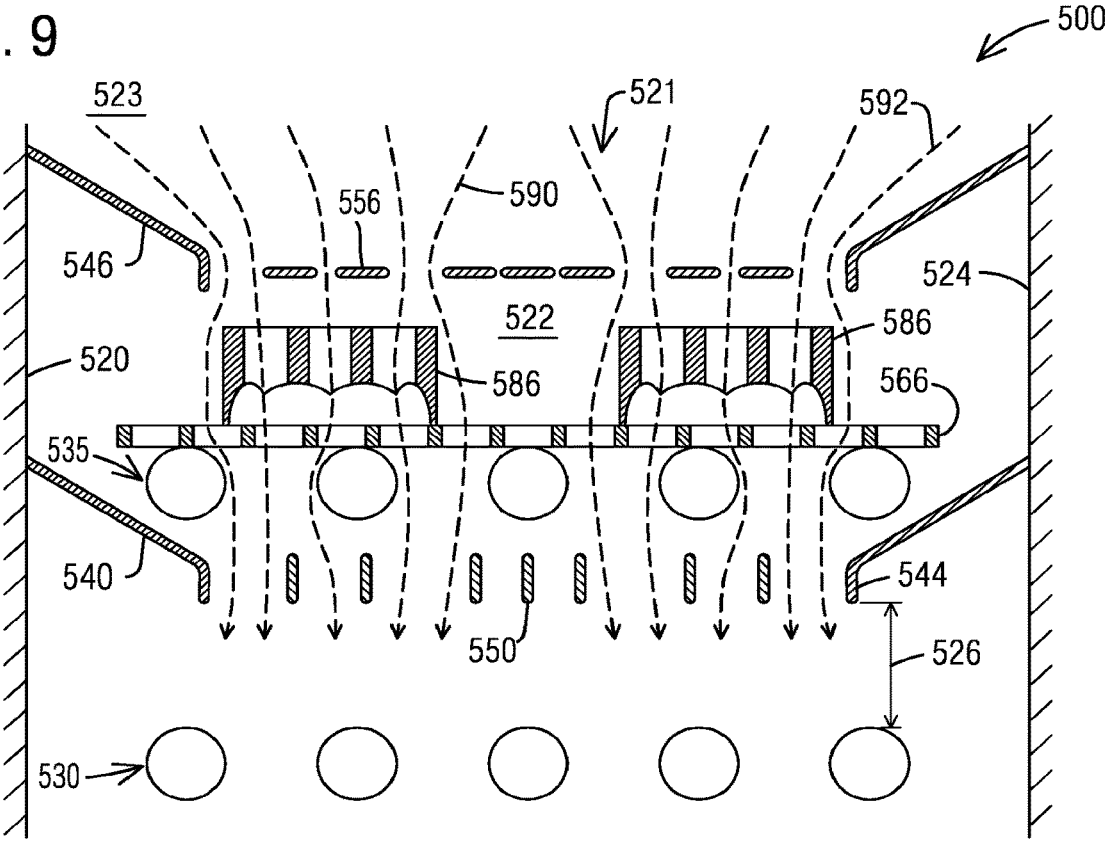

FIGS. 8 and 9 are schematic side views of another representative embodiment of the improved forced air quench system 500 that includes two roller conveyor systems 530, 535, with a second or upper roller conveyor 535 positioned directly above the first or lower roller conveyor 530 in the center portion 522 of the cooling chamber 522 defined by the sidewalls 524 of the quench housing 520. However, in this embodiment the forced air fans (not shown) are located above the quench stations, so that the stream of cooling air 590 provided by the fans flows downward through both roller conveyor systems 530, 535. As described above, the second roller conveyor 535 can be useful for minimizing the switch out time between a first casting tray 560 loaded with a first group of metallic components 580 (FIG. 8) and a second casting tray 566 loaded with a second group of metallic components 586 (FIG. 9), as the upper casting tray 566 can be moved into position on the upper quench station without interfering with the simultaneous withdrawal of the lower casting tray 560 from the lower quench station.

Both quench stations in the forced air quench system 500 can include a set of nozzle baffles 540, 546 and a set of movable central baffles 550, 556. The nozzle baffles 540, 546 can be fixed, and can serve to redirect those portions 592 of the cooling air 590 that flow downward through the peripheral portions 523 of the cooling chamber 522 away from the sidewalls 524 and toward the center portion 521 of the cooling chamber 522, thereby focusing and increasing the speed of the forced cooling air 590 as it flows downward through and around the metallic components that are supported on the casting trays. In this embodiment, however, the nozzle baffles 540, 546 can extend inward from the sidewalls 524 at locations above the roller conveyors 530, 535 of each quench station and by a distance 526 that allows a component support 560, 566 loaded with metallic components 580, 586 to roll in under the nozzle baffles, which in one aspect can include the lower vertical lips 544, 548 shown in the illustrated embodiment. In addition, since the nozzle baffles are located above the quench stations, the size and shape of the nozzle baffles 540, 546 is not constrained by the roller conveyers. This can allow the nozzle baffles to be configured or customized, if so desired, to more accurately conform to the footprint of the metallic components 580, 586 that are loaded on their respective casting trays 560, 566. As these flow areas will generally be much smaller than the total cross-sectional area of the quench closure 220, the nozzle baffles 240, 246 can provide a first redirection or concentration of the forced air flow and a corresponding first stage increase in flow velocity.

Similar to the embodiments of the forced air quench system described above, the movable central baffles 550, 556 that are positioned near or within the mouth of the nozzle baffles 540, 546 can provide a second and more localized redirection or concentration of the forced air flow and a corresponding second stage increase in flow velocity. The central baffles 550, 556 can also be provided with shaped profiles that can define and shape the streams of cooling air to correspond with openings and/or other structures formed into the metallic components below, and in this way can be used to tailor the cooling stream to provide improved cooling for specific metallic components. However, since the movable central baffles 550, 556 are also located above the quench stations and not constrained by the roller conveyers 530, 535, the number, size and shape of the central baffles 550, 556 can be substantially different than those movable baffle designs that are intermixed with the rollers (see, for example, the embodiments of FIGS. 3-4 or FIG. 7)

With reference to FIG. 8, when the first casting tray 560 loaded with a first group of metallic components 580 is positioned within the lower quench station (FIG. 8), the central baffles 550 that are associated with the first station can be moved or rotated to their active orientations (in the depicted case, a horizontal orientation) that redirects and concentrates the downwardly-flowing forced cooling air into narrow gaps or shaped channels 535 that correspond with openings or other structures formed into the metallic components 580 below. At the same time, the central baffles 556 that are associated with the second quench station (that is now upstream of the first quench station) can be moved to their vertical or inactive orientations so as to reduce any drag and pressure loses caused by the overlying structures.

When the first casting tray 560 is withdrawn from the lower quench station and the second casting tray 566 loaded with a second group of metallic components 586 is positioned within the upper quench station (FIG. 9), the central baffles 550 that are associated with the first station can be moved to their vertical or inactive orientations so as to reduce the backpressure generated by the structures that are now downstream of the metallic components being quenched. At the same time, the central baffles 556 that are associated with the second quench station can be moved or rotated to their active orientations (e.g. a horizontal orientation) that redirects and concentrates the downwardly-flowing forced cooling air into narrow gaps or shaped channels 535 that correspond with the openings or other structures formed into the metallic components 586 immediately below.

As indicated above, the invention has been described herein in terms of preferred embodiments and methodologies considered by the inventor to represent the best mode of carrying out the invention. It will be understood by the skilled artisan, however, that a wide range of additions, deletions, and modifications, both subtle and gross, may be made to the illustrated and exemplary embodiments of the composite substrate without departing from the spirit and scope of the invention. For instance, in some embodiments the nozzle baffles may not be fixed structures extending inward from the sidewalls of the quench system housing, but instead may be movable and/or reconfigurable flow directing elements that can be adjusted to accommodate differently-sized component supports. And in other embodiments where the conveyance system is not a roller conveyor, such as, for instance, a robotic manipulator, it will be appreciated that the number, size and shape of the central baffles can be substantially different than those movable baffle designs that are intermixed with the rollers, while still affecting a second stage increase in the average flow velocity. These and other revisions might be made by those of skill in the art without departing from the spirit and scope of the invention that is constrained only by the following claims.

What is claimed is:

1. A quench system for applying cooling air to a hot metallic component supported on a component support, the quench system comprising:

a housing having sidewalls defining a cooling chamber with peripheral portions proximate the sidewalls and a center portion spaced inwardly from the sidewalls;

a conveyance system configured to carry a component support into the center portion of the cooling chamber;

a source of forced air for generating a bulk flow of cooling air through the cooling chamber; and a plurality of spaced apart central baffles positioned adjacent the conveyance system in the center portion of the cooling chamber downstream from the source of forced air, the spaced apart central baffles being movable relative to one another, adjacent ones of the spaced apart central baffles defining a gap there between, and each of the central baffles of the plurality of spaced apart central baffles being selectively movable along a range of positions between a widest-gap position that maximizes the distance between adjacent central baffles and a narrowest-gap position that minimizes the distance between adjacent central baffles.

2. The quench system of claim 1, wherein the conveyance system comprises a roller conveyor system that includes a plurality of support rollers separated by gaps between support rollers and wherein central baffles of the plurality of central baffles are located within or proximate the gaps between support rollers and are configured to direct the cooling air into channels between the central baffles and the support rollers.

3. The quench system of claim 2, wherein at least one of the central baffles is selectively rotatable between a first orientation that directs the cooling air into the channels between the central baffles and the support rollers and a second orientation that allows the cooling air to flow substantially unobstructed through the gaps between support rollers.

4. The quench system of claim 2, wherein at least one of the central baffles further comprises an elongate vane structure having a length substantially spanning a length of the support rollers and a width extending across the gap between support rollers when the at least one central baffle is positioned in the narrowest-gap position.

5. The quench system of claim 2, wherein a width of at least one central baffle varies along the length thereof to shape the cooling air flowing through an adjacent channel into a directed stream of cooling air that impinges on a hot metallic component supported on a component support in the center region of the cooling chamber.

6. The quench system of claim 2, wherein at least one central baffle of the plurality of central baffles is moveable into a position to direct the cooling air between a gap or channel between the at least one central baffle and one of the support rollers to form a directed stream of cooling air flowing around the hot metallic component and/or toward a passage through a hot metallic component to increase the transfer of heat away from the hot metallic component.

7. The quench system of claim 2, further comprising a second roller conveyor system located downstream of the roller conveyor system and configured to carry a second component support having at least one hot metallic component supported thereon into the center portion of the cooling chamber; and a second plurality of central baffles located within or proximate the gaps between support rollers of the second roller conveyor system and configured to further direct the cooling air into channels between the second plurality of central baffles and the support rollers of the second roller conveyor system.

8. The quench system of claim 7, wherein each of the pluralities of central baffles include at least one central baffle that is selectively movable between a first orientation that directs the cooling air into the channels between the central baffles and adjacent support rollers and a second orientation that allows the cooling air to flow substantially unobstructed through the gaps between the adjacent support rollers.

9. The quench system of claim 1, further comprising a plurality of nozzle baffles that affects a first stage increase in an average velocity of the cooling air flowing through the cooling chamber prior to encountering a hot metallic component in the cooling chamber and wherein the plurality of central baffles affects a second stage increase in the average velocity of the cooling air flowing through the cooling chamber prior to encountering hot metallic component in the cooling chamber.

10. A quench system for applying cooling air to a hot metallic component supported on a component support, which component support has a substantially open construction allowing for air flow therethrough, the quench system comprising:

a housing having sidewalls defining a cooling chamber with peripheral portions proximate the sidewalls and a center portion spaced inwardly from the sidewalls;

a platform located within the cooling chamber and configured to position a component support proximate the center portion of the cooling chamber;

a source of forced air for generating a bulk flow of cooling air through the cooling chamber at a first average velocity; and a first plurality of flow directing elements located upstream of the platform and configured to increase the flowrate of the cooling air to a second average velocity greater than the first average velocity, and a second plurality of flow directing elements located between the first plurality of flow directing elements and the platform, each flow directing element of the second plurality of flow directing elements being selectively movable between a first orientation and a second orientation, wherein the second plurality of flow directing elements is configured to further increase the flowrate of the cooling air to a third average velocity greater than each of the first average velocity and the second average velocity when the flow directing elements of the second plurality of flow directing elements are in their first orientations, but to a velocity less than the third average velocity when in their second orientations.

11. The quench system of claim 10, further comprising a second platform located downstream of the platform and configured to position a second component support bearing at least one additional hot metallic component thereon proximate the center portion of the cooling chamber;

and a third set of flow directing elements located downstream of the first and second sets of flow directing elements and configured to alternate with the second set of flow directing elements to further increase the flowrate of the cooling air flowing through the cooling chamber to the third average velocity greater than each of the first average velocity and the second average velocity.

12. The quench system of claim 10, wherein the first set of flow directing elements comprises a plurality of nozzle baffles extending inwardly from the plurality of sidewalls, the plurality of nozzle baffles defining a narrowing region within the housing between source of forced air and the platform, whereby, during generation of bulk flow of cooling air, cooling air flowing through the peripheral portions of the cooling chamber is redirected into the center portion of the cooling chamber.

* * * * *